US006811103B2

(12) United States Patent
Gürich et al.

(10) Patent No.: US 6,811,103 B2
(45) Date of Patent: Nov. 2, 2004

(54) DIRECTLY CONTROLLED FUEL INJECTION DEVICE FOR A RECIPROCATING INTERNAL COMBUSTION ENGINE

(75) Inventors: Gunter Gürich, Aachen (DE); Hermann Joseph Laumen, Heinsberg (DE); Karl Joachim Schmücker, Eynatten (BE)

(73) Assignee: FEV Motorentechnik GmbH, Aachen (DE)

( * ) Notice: Subject to any disclaimer, the term of this patent is extended or adjusted under 35 U.S.C. 154(b) by 0 days.

(21) Appl. No.: 10/181,570

(22) PCT Filed: Dec. 15, 2000

(86) PCT No.: PCT/EP00/12777

§ 371 (c)(1),
(2), (4) Date: Sep. 30, 2002

(87) PCT Pub. No.: WO01/53688

PCT Pub. Date: Jul. 26, 2001

(65) Prior Publication Data

US 2003/0146305 A1 Aug. 7, 2003

(30) Foreign Application Priority Data

Jan. 18, 2000 (DE) ..... 100 01 828

(51) Int. Cl.[7] ..... F02M 59/00

(52) U.S. Cl. ..... 239/533.2; 239/88; 239/91; 239/92; 239/585.1; 123/467

(58) Field of Search ..... 239/88, 89, 90, 239/91, 95, 96, 533.2, 585.1, 585.2, 585.5; 123/467, 506, 601.14

(56) References Cited

U.S. PATENT DOCUMENTS 5,526,791 A 6/1996 Timmer et al.
5,893,350 A * 4/1999 Timms ..... 123/467
5,979,790 A * 11/1999 Gurich et al. ..... 239/88

FOREIGN PATENT DOCUMENTS

DE 43.41 546 A 6/1995
DE 297 17 649 U 11/1997
DE 197 06 647 C 3/1998

* cited by examiner

*Primary Examiner*—Dinh Q. Nguyen
(74) *Attorney, Agent, or Firm*—Venable LLP; Catherine M. Voorhees

(57) ABSTRACT

The invention relates to a fuel injection device for a reciprocating internal combustion engine, comprising a nozzle part (5) with an injection nozzle (13), said nozzle part having a pressure chamber (10) in which a nozzle needle (9) that closes the injection nozzle (13) is guided. Said nozzle needle can be moved into the opening position when subjected to pressure by the fuel to be injected. The pressure chamber (10) is connected to a control part (7) by a connecting channel (6), this control part having a valve chamber (21) into which the connecting channel (6) and a high pressure channel (8) that is connected to a fuel supply (4) open, and in which a valve body (23) is guided. Said valve body (23) acts as a piston system and is held in the closing position by a valve spring and a valve seat (22). The nozzle part also comprises an actuator part (20) which is functionally connected to the valve body (23) and which when activated, moves said valve body in the opening direction and releases the through-flow from the high pressure channel (8) into the connecting channel (6).

14 Claims, 8 Drawing Sheets

Figure 1:
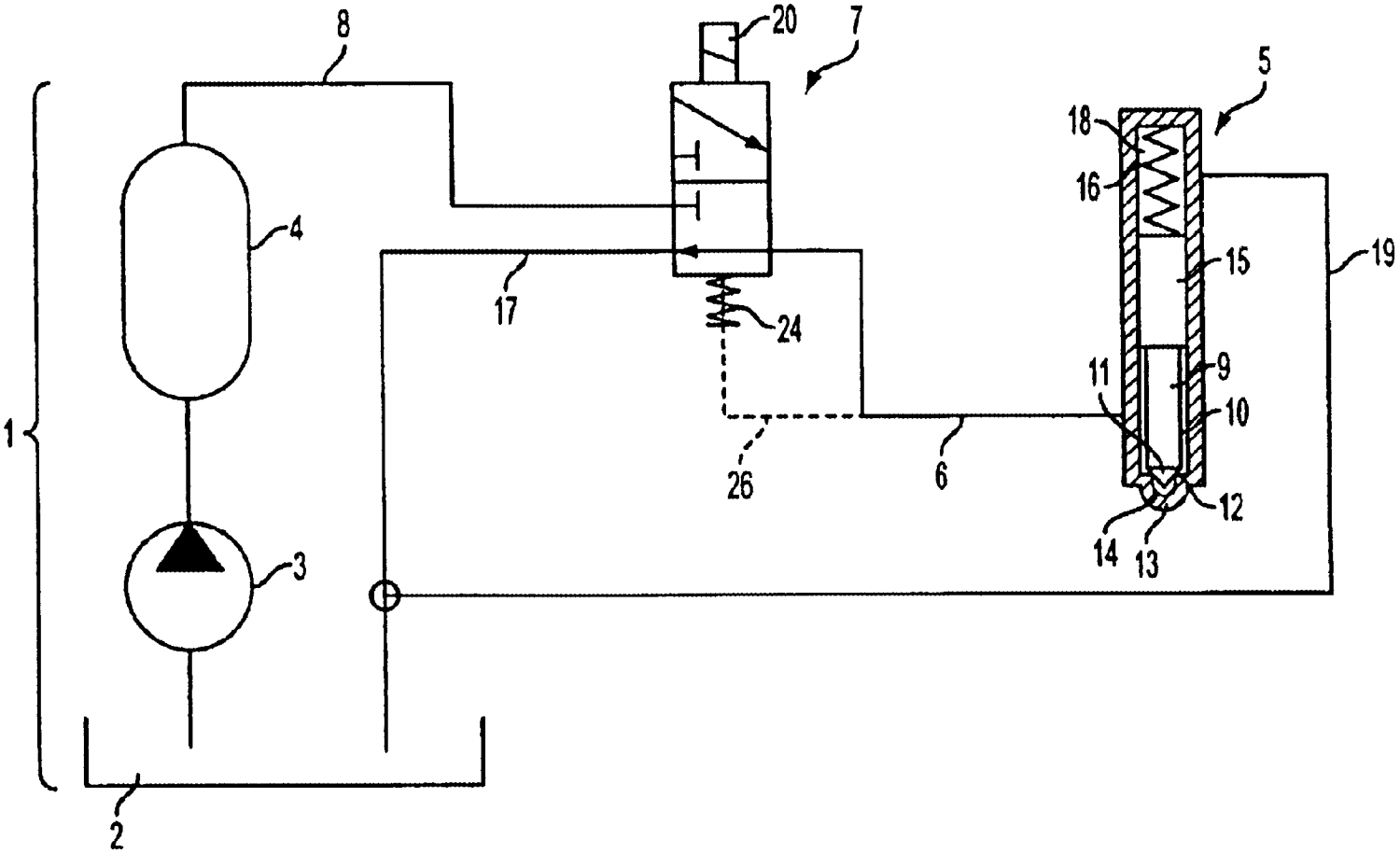

DIRECTLY CONTROLLED FUEL INJECTION DEVICE FOR A RECIPROCATING INTERNAL COMBUSTION ENGINE

Fuel injection devices embodied as so-called common rail systems, for a reciprocating internal combustion engine with direct fuel injection, essentially comprise a nozzle part with an injection nozzle, which part has a nozzle needle that closes the injection nozzle and that is movable in the opening position via servo hydraulics upon imposition of pressure by the fuel to be injected. The requisite pilot pressure is taken from the high-pressure part of the fuel supply, that is, the common rail. Via the pressure specification in the common rail, the injection pressure can be varied quite flexibly, and via the triggering of a servo valve, and thus of the nozzle needle, the instant of injection and duration of injection can also be adjusted with great flexibility.

However, if with the known systems not only the injection quantity is to be dimensioned, by a suitable control of the opening time, but the injection rate is also to be formed, that is, the injection quantity per unit of time is to be varied during the opening time, then the stroke of the nozzle needle must be controlled. However, the hydraulic energy of the flowing fuel is set to turbulence immediately upstream of the injection port of the injection nozzle by the so-called seat throttling, which occurs especially at a relatively short needle stroke, since the free flow cross section between the nozzle needle and the nozzle needle seat, which varies as a function of the stroke, acts as a throttle. The resultant increased turbulence in the flowing fuel in the region of the injection port affects the mixture formation, so there is no "genuine" rate control. In direct fuel injection, that is, injection of the fuel directly into the cylinder chamber, this is disadvantageous. As a consequence of this increase in turbulence, at small injection quantities, for instance, [injection quantities, for instance,] (sic) combustion near the nozzle of the injected fuel quantity has been found, which adversely affects the course of the combustion process.

From U.S. Pat. No. 5,526,791, German Patent Disclosure DE-A 43 41 546, and German Utility Model DE-U 297 17 649, fuel injection devices are known that each have a valve body which can be displaced into the open position by an activated actuator and allows the inflow of fuel at high pressure. If the actuator is inactivated, a restoring spring pushes the valve body back into the closing position.

The object of the invention is to create a fuel injection device for direct fuel injection that makes it possible during the applicable injection time to vary the injection quantity, or in other words to shape the injection rate.

This object is attained by a fuel injection device for a reciprocating internal combustion engine, having a nozzle part with an injection nozzle, which part has a pressure chamber in which a nozzle needle that closes the injection nozzle is guided, which needle is movable in the opening position upon imposition of pressure by the fuel to be injected, wherein the pressure chamber communicates via a connecting channel with a control part which has a valve chamber, into which the connecting channel on the one hand and a high-pressure channel, communicating with a fuel supply, on the other discharges, and in which a valve body acting as a piston system is guided, which body is kept in the closing position on a valve seat by a valve spring, and having an actuator, which is operatively connected to the valve body and which moves the valve body in the opening direction upon activation and enables the flow from the high-pressure channel into the connecting channel, and having a compensation piston, which can be acted upon via the pressure in the connecting channel in the opposite direction from the exertion of force by the actuator.

In the fuel injection device of the invention, the nozzle part is embodied such that upon pressure imposition, the nozzle needle opens the flow cross section to the nozzle openings as completely as possible; no intermediate positions are provided. The control of the volumetric flow is effected via the valve body, provided in the control part, whose stroke is variable by means of suitable triggering of the actuator. The valve body is preferably embodied as a seat valve, to assure tightness in the closed state. The actuator is expediently embodied such that in terms of its adjustment travel, it is embodied adjustingly in proportion to the adjustment energy applied. Electrical actuators which are embodied adjustingly in proportion to voltage in terms of their adjustment travel, of the kind embodied by so-called solid-state actuators, are especially suitable for this purpose. As solid-body actuators, piezoelectric actuators can be considered in particular, but also magnetostrictive actuators. Electromagnetically functioning actuators can also be used. It is advantageous to dispose a compensation piston of suitable diameter, which can be acted upon via the pressure in the connecting channel toward the nozzle part and accordingly acts counter to the force of the actuator. This produces a so-called pressure feedback, which enables good regulability of the volumetric flow flowing from the high-pressure side to the connecting channel, and thus enables good shaping of the injection rate.

It is especially expedient if in one embodiment, the valve body is provided, on an end remote from the actuator, with a compensation piston which can be acted upon via the pressure in the connecting channel.

In a feature of the invention, it is provided that the control part has a relief valve, opening toward the low-pressure side of the fuel supply, which is associated with the connecting channel and closes upon activation of the actuator. By the disposition of a relief valve of this kind, care is taken to assure that immediately upon seating of the valve body in the control part on its valve seat, the pressure in the connecting channel toward the nozzle part is rapidly decreased, so that the nozzle needle is also guided very quickly into its closing direction.

In an especially advantageous feature of the invention, it is also provided that the control part has a pressure divider, which communicates on the one hand with the high-pressure channel and on the other with the valve body with a compensation piston, forming a piston system, and which is adjustable via the actuator. Disposing a pressure divider in the control part in this way enables dynamic adjustment of whatever injection pressure is desired. Depending on the embodiment, the arrangement can be such that depending on the type of actuator used, the injection pressure can be adjusted upstream of a pressure-controlled injection nozzle, either via the adjustment travel of the actuator or via the force of the actuator.

Further characteristics and features of the invention can be learned from the claims and the ensuing description of exemplary embodiments.

Figure 2:
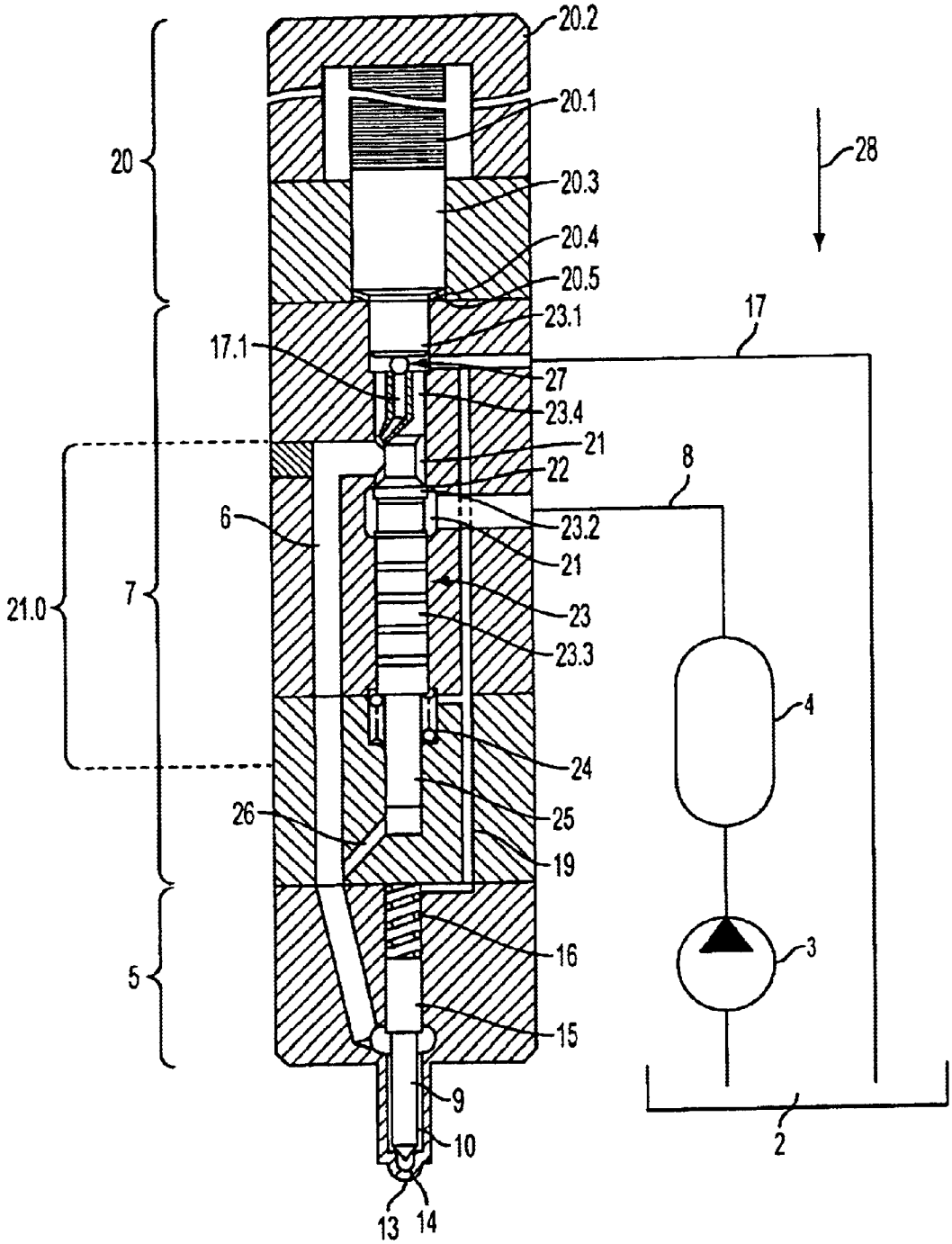
Figure 3:
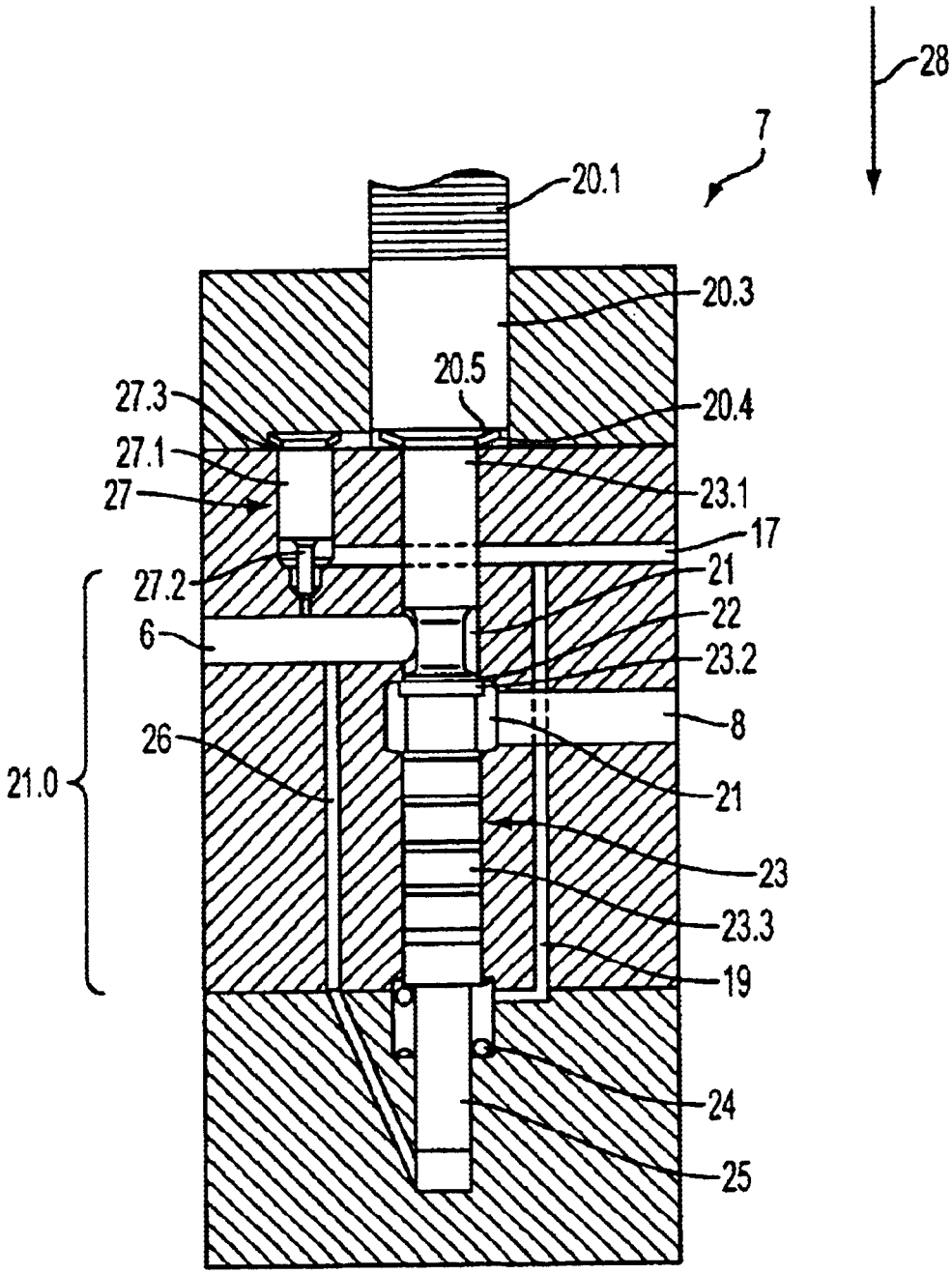
Figure 4:
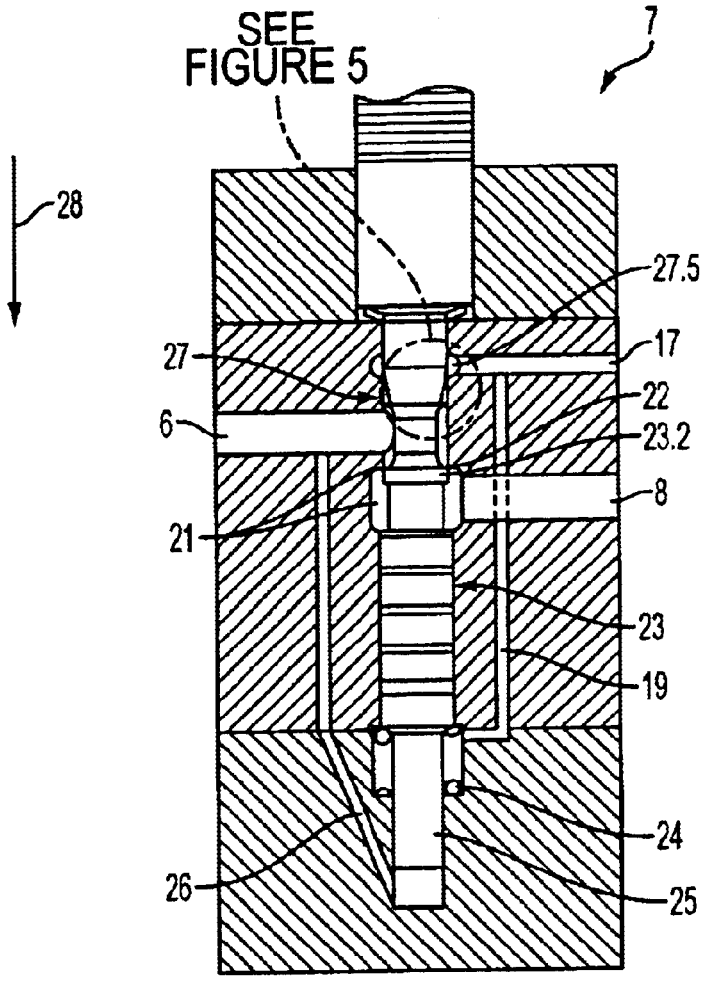
Figure 5:
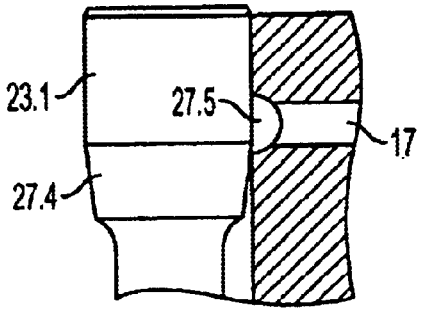
Figure 6:
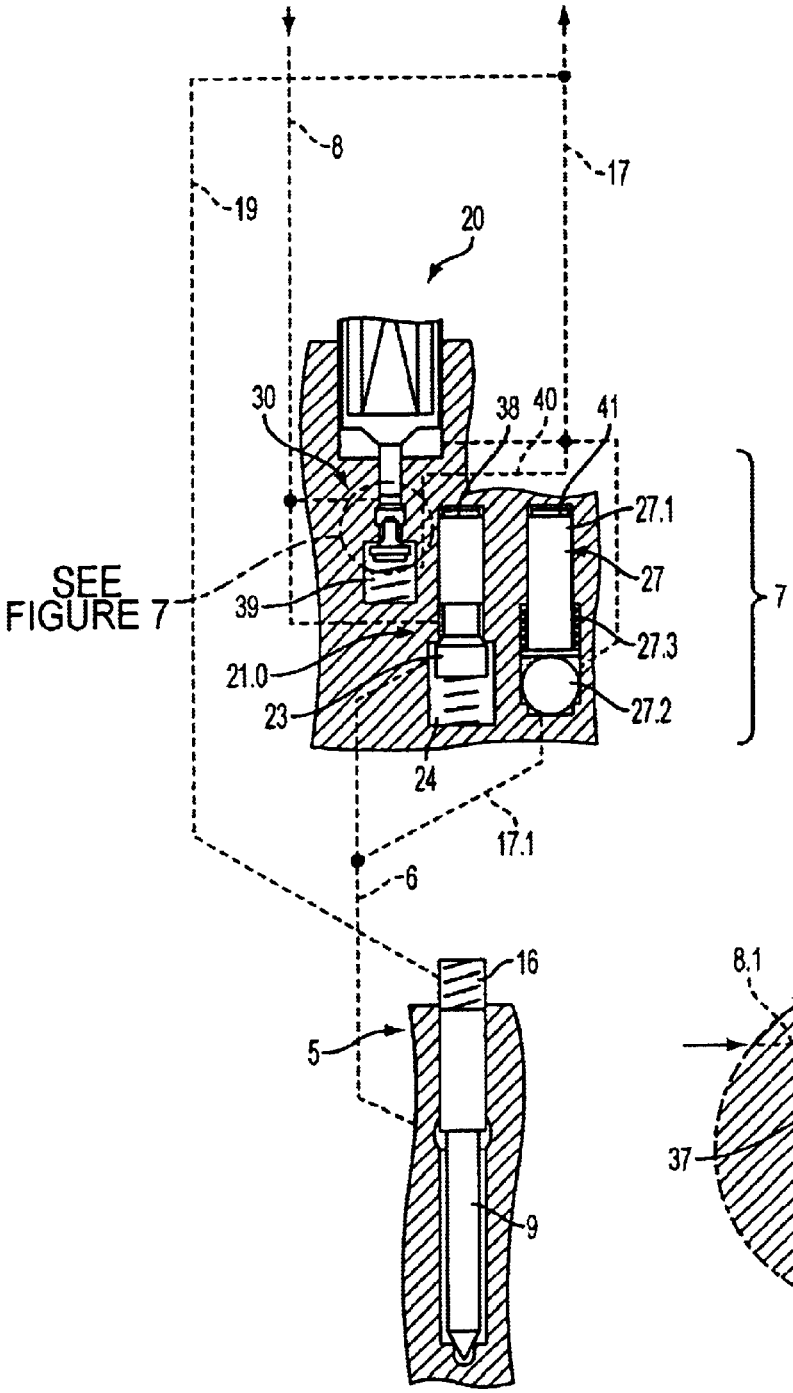
Figure 7:
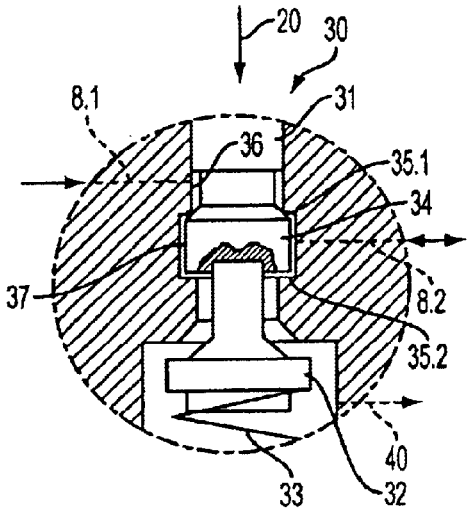
Figure 8:
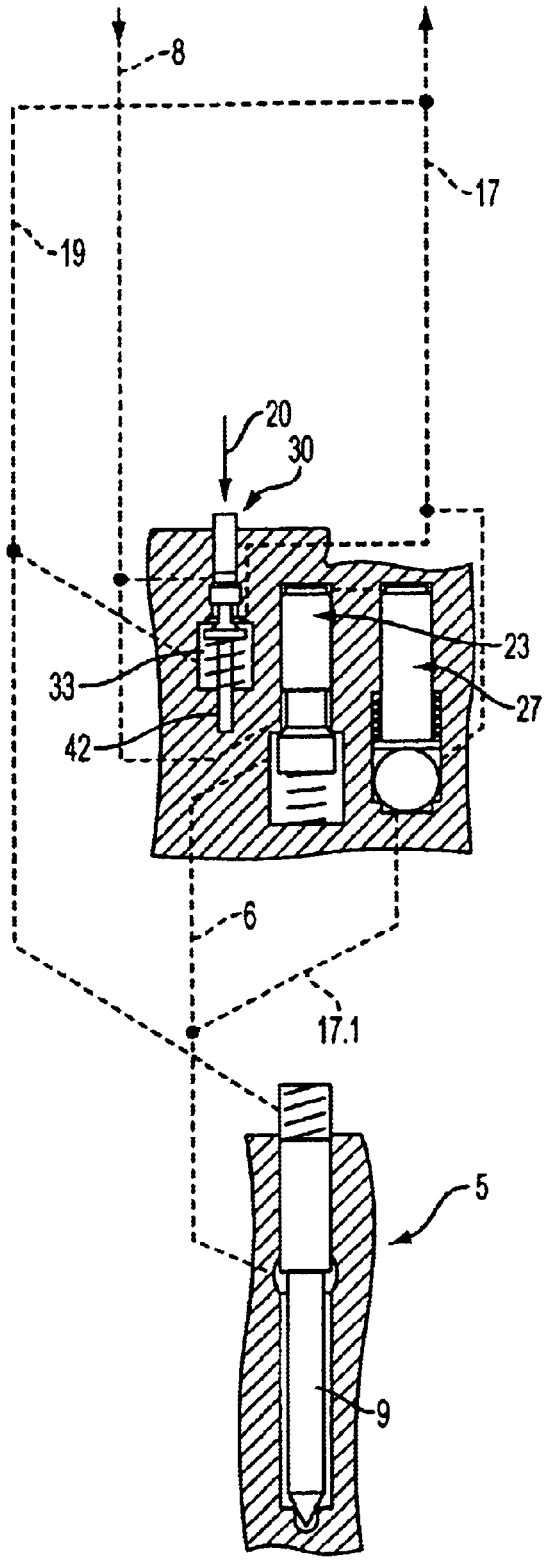
Figure 9:
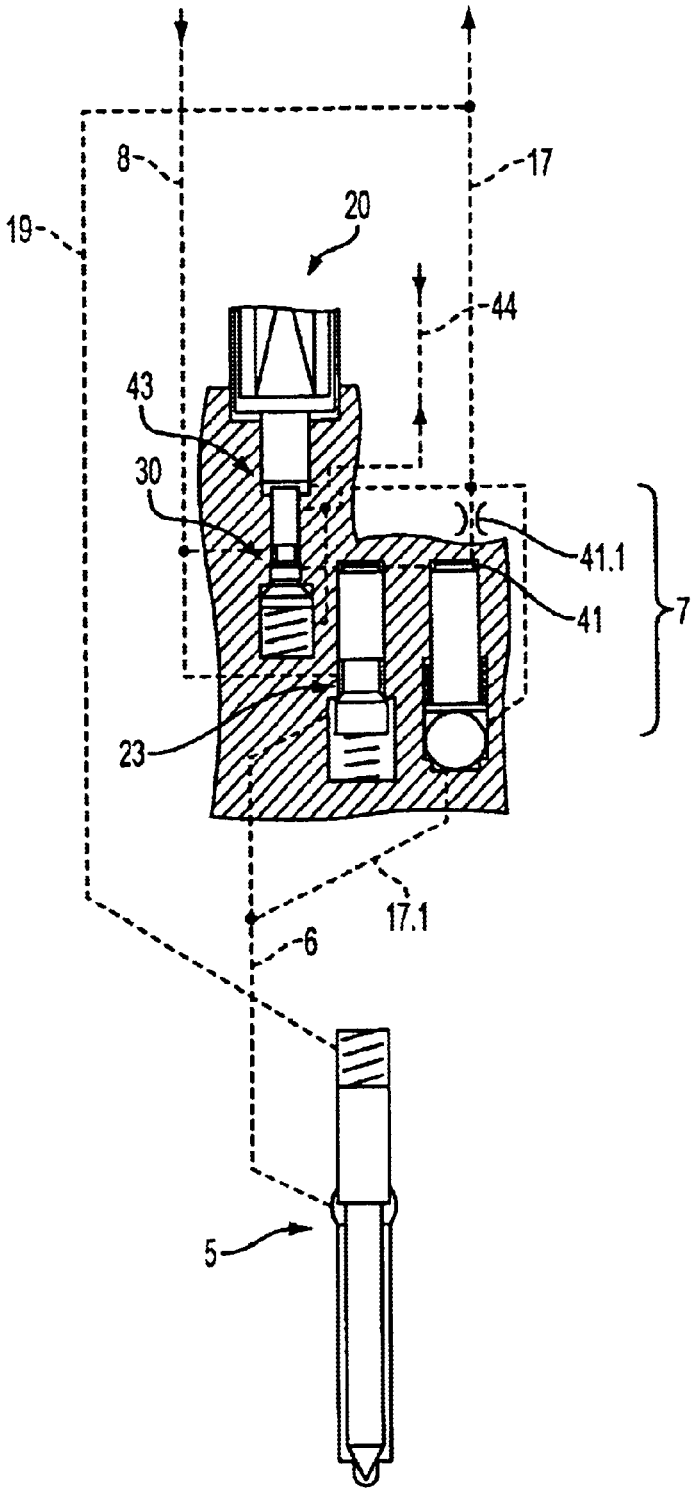
Figure 10:
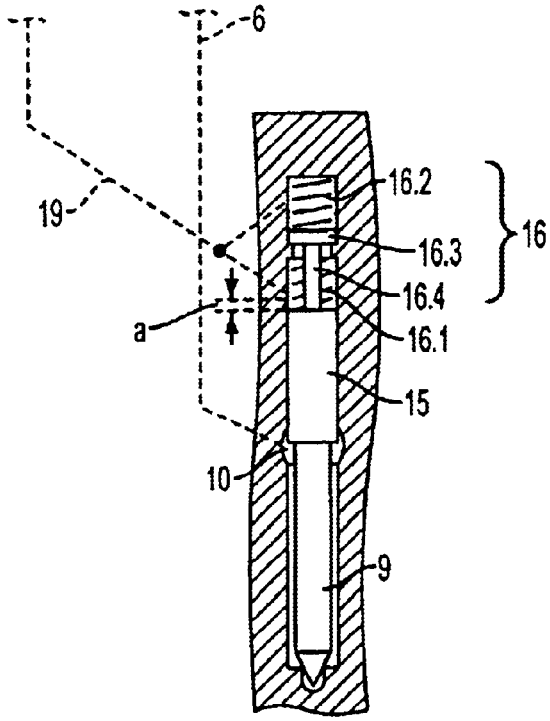
Figure 11:
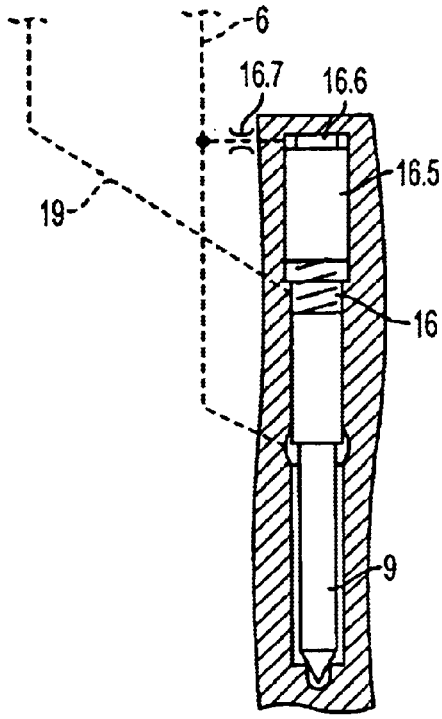

The invention will be explained in further detail in terms of schematic drawings of exemplary embodiments. Shown are:

FIG. 1, a circuit diagram of a fuel injection device;

FIG. 2, an exemplary embodiment of a fuel injection valve with a nozzle part and control part;

FIG. 3, a modified embodiment of the control part;

FIG. 4, a further modification of the control part;

FIG. 5, the detail A in FIG. 4 on a larger scale;

FIG. 6, a modified embodiment with a pressure divider integrated with the control part;

FIG. 7, the pressure divider of FIG. 6 on a larger scale;

FIG. 8, an embodiment of the pressure divider with a support piston;

FIG. 9, an embodiment of the pressure divider with a hydraulic travel booster;

FIG. 10, an embodiment of the fuel injection nozzle with a two-spring support;

FIG. 11, an embodiment of the fuel injection nozzle with an escape piston.

In FIG. 1, a fuel injection device for direct injection of the fuel into the individual cylinders of a reciprocating internal combustion engine is shown in the form of a flow chart. The fuel injection device has a fuel supply 1, which is essentially formed by a fuel tank 2, a high-pressure pump 3, and a high-pressure chamber 4 or so-called common rail.

Each cylinder of the reciprocating internal combustion engine is provided with a nozzle part 5, which communicates with the fuel supply 1 via a connecting channel 6, a control part 7, and a high-pressure channel 8. The control part 7 further communicates with an engine controller, not shown in detail here, by which the control part 7, acting as a control valve, can be triggered such that at the instant of injection, the communication between the high-pressure channel 8 and the connecting channel is opened, and the fuel that is at high pressure can act on the nozzle part 5. The special mode of operation will be described in further detail hereinafter.

The nozzle part 5 is essentially formed by a nozzle needle 9, which is guided in a pressure chamber 10 into which the connecting channel 6 discharges. The nozzle needle 9 has a needle tip 11, which cooperates with a corresponding seat 12 of the injection nozzle 13 and acts as a valve. The injection nozzle 13 is provided with corresponding nozzle openings 14. On the side remote from the needle tip 11, the nozzle needle 9 is provided with a piston body 15, on which a closing spring 16 acts in the closing direction. If the communication between the high-pressure channel 8 and the connecting channel 6 is opened via the control part 7 and the pressure chamber 10 and thus the piston body 15 are acted upon by pressure, then the nozzle needle 9 lifts from its valve seat 12, so that the fuel from the pressure chamber 10 can emerge through the nozzle openings 14 into the combustion chamber of the applicable cylinder of the reciprocating internal combustion engine, in the form of a fine mist. As soon as the communication with the high-pressure chamber 4 is closed via the control part 7, the nozzle needle 9 is pressed back onto its valve seat via the closing spring 16, and the fuel delivery is terminated.

Upon the return of the control part 7 to its closing direction, a communication between the connecting channel 6 and a low-pressure channel 17 is opened, so that the pressure chamber 10 is pressure-relieved and the nozzle needle can rapidly be returned to its closing direction. The nozzle part 5 acting as an injection valve is conceived of in the exemplary embodiment such that upon imposition of pressure, it opens the injection nozzle 13 completely and closes it upon pressure relief, so that depending on the triggering via the control part 7, opening and closure of the injection nozzle at precise times is assured. In the arrangement shown in FIG. 10 of two closing springs 16.1 and 16.2 with different spring stiffness, the goal is for the nozzle needle 9 to be capable of assuming two opening positions as a function of pressure.

The closing spring 16 is disposed in a leakage chamber 18, which communicates via a leakage line 19 with the low-pressure line 17, so that the amounts of leakage collecting in the leakage chamber 18 can be diverted into the fuel tank 2.

The actuator 20 is preferably embodied such that in terms of its adjustment travel, it is embodied adjustingly in proportion to the adjustment energy applied. In an embodiment of the control part 7, for instance as a throttle valve, the possibility thus exists of varying the volumetric flow, flowing out of the high-pressure channel 8 into the connecting channel 6, by suitably adjusting the opening cross section in the control part 7. Since upon pressure imposition, the nozzle part 5 embodied as an injection valve opens completely, in the schematic example shown, it is possible via a suitable change in the adjustment of the control part 7 for the volumetric flow delivered to the nozzle part 5 to be varied during the duration of opening of the injection nozzle 13.

The structure and function of the control part 7 will now be described in further detail in terms of various exemplary embodiments.

The actuator 20 is advantageously embodied as a so-called solid-state actuator. Preferably, an actuator functioning piezoelectrically is used, which in terms of its adjustment travel, or because of its mechanical resilience, is embodied as adjusting its adjusting force in proportion to voltage. Instead of a piezoelectric actuator, the use of a magnetostrictive actuator is also possible, which is embodied as adjusting in proportion to current in terms of its adjustment travel. Since such solid-state actuators are distinguished by high switching speed, good regulability of the adjustment travel, and also high adjusting forces and moreover act directly, or optionally via a hydraulic stroke boost, on the adjusting part in the control part 7, the possibility is obtained, even at only short opening times for the nozzle part 5 embodied as an injection valve, of purposeful shaping of the injection rate, that is, a purposeful change in the volumetric flow introduced into the combustion chamber of the applicable cylinder during the opening time of the injection valve.

While it is possible in principle to use the nozzle part 5 and the control part 7 as separate component units, in FIG. 2 an embodiment is shown in which the nozzle part 5 and control part 7 are embodied together with the actuator 20 as a structural unit. From the description of this exemplary embodiment, the special features of the embodiment of the control part 7 indicated above can also be found. Reference numerals used in FIG. 1 for components described above are also adopted in FIG. 2, so that the above description can be referred to.

As can be seen from FIG. 2, the entire arrangement comprises a carrier body, constructed in multiple parts for production reasons, which is characterized by a coaxial relationship among the nozzle part 5, control part 7 and actuator 20.

The control part 7 has a valve assembly 21.0 with a valve chamber 21.1, into which the high-pressure channel 8 on the one hand and the connecting channel 6 on the other discharge. The valve chamber 21.1 is provided with a valve seat 22, on which a valve body 23 embodied as a piston system is held in the closing direction by its valve part 23.1 via a valve spring 24, so that the high-pressure channel 8 is blocked off from the connecting channel 6. The structural space required for the valve spring 24 communicates with the leakage line 19. Some of the portions 23.1, 23.2, 23.3 and 23.4 have different diameters here.

On the side remote from the valve spring 24, the actuator 20 acts on the valve body 23; in the exemplary embodiment shown here, it is embodied as a piezoelectric actuator. The piezoelectric actuator 20 is essentially formed by a stack of piezoelectric bodies 20.1, which are connected to a controllable voltage source, not shown here, and are braced on one end on a housing part 20.2 and on the other act on a transmission piston 20.3. The transmission piston 20.3 is assigned a hydraulic chamber 20.4, which is filled in a known manner with a fluid, in this case fuel.

On the side toward the control part, the hydraulic chamber 20.4 is assigned a pressure piston 23.1, which communicates with the valve body 23. If the piezoelectric body 20.1 is subjected to a voltage, then the transmission piston is moved forward in the direction of the hydraulic chamber 20.4, and then under the influence of the fluid contained in the hydraulic chamber 20.4, the pressure piston 23.1 is displaced as well. Because the pressure piston 23.1 has a smaller diameter than the transmission piston 20.3, a stroke boost is obtained; that is, depending on the diameter ratio, the valve body 23 is displaced over a correspondingly longer path relative to the voltage-proportional lengthening of the piezoelectric body 20.1.

The change in length of the piezoelectric body 20.1 takes place in proportion to voltage, so that depending on the voltage applied, the valve body 23 lifts with its valve part 23.1 from the valve seat 22 and thus opens a corresponding flow cross section, so that a volumetric flow corresponding to the throttling between the valve seat 22 and the valve part 23.1 can flow out of the high-pressure channel 8 into the connecting channel 6 and then lift the nozzle needle 9 and open the injection nozzle 13. Depending on the opening cross section uncovered at the valve part 23.1 and depending on the duration of the opening, fuel then flows via the nozzle openings 14 into the combustion chamber of the applicable cylinder. If the voltage at the piezoelectric body 20.1 is reduced, then via the valve spring 24, the valve part 23.1 is pressed against the valve seat 22, thus preventing fuel delivery.

On the nozzle end of the valve body 23, a compensation piston 25 is provided, which has a smaller diameter than the valve part 23.2. The compensation piston 25 can be connected to the valve body, as shown, or can be separate from the valve body. This compensation piston 25 is acted upon the pressure prevailing in the connecting channel 6 via a branch line 26 branching off from the connecting channel 6. The result is a force feedback via the pressure in the closing direction of the valve body 23, or in other words counter to the force of the actuator 20. The effect is that the valve body 23 does not act solely counter to the force of the actuator 20 by means of the valve spring 24; instead, the force feedback assures that the valve body 23, during its longitudinal motion, both in the opening direction and the closing direction adapts without play and without delay to any change in length of the actuator, and hence an energy-dependent, or in the case of a piezoelectric actuator a voltage-dependent, change in length can be transmitted exactly to the motion of the valve body 23. Pivoting motions are suppressed. As a result of the adaptation of the various diameters or surface areas exposed to the pressure imposition, such as the diameter of the guide parts 23.3 and 23.4 of the valve body and the diameter of the compensation piston 25, the degree of the force feedback can be dimensioned. For a high degree of feedback, the regulability becomes better but requires more-powerful actuators.

This force feedback makes it possible to use a simple electromagnetic actuator, instead of a piezoelectric actuator; in an electromagnetic actuator, the adjusting force is proportional to the energy input, and thus a more precisely defined action on the injection nozzle is possible.

The low-pressure channel 17, which continues with part of its length 17.1 inside the valve body 23 and connects the low-pressure channel 17 to the connecting channel 6, is provided with a relief valve 27, shown here as a simple ball valve. Since a tension spring 20.5 is disposed between the transmission piston 20.3 and the pressure piston 23.1 in the hydraulic chamber 20.4, the pressure piston 23.1 is pressed in the state of repose via a tension spring 20.5 against the ball acting as a relief valve 27, thus keeping the latter in the closing position.

If the actuator 20 is acted upon and the valve body 23 is displaced in the opening direction (arrow 28), the relief valve 27 is kept in the closing direction. When the electrical voltage at the actuator 20 is shut off, the actuator abruptly shortens its length, so that because of inertia and the injection pressure prevailing in the connecting channel 6, the transmission piston 23.1 is lifted from the ball, and the flow cross section is thus opened. Thus the injection pressure still prevailing in the connecting channel 6 can be decreased quickly via the low-pressure channel 17 to the fuel tank 2, so that the nozzle needle 9 is likewise put with precise timing in the closing direction via the closing spring 16.

By a suitable adaptation of the relief valve, it can be attained that the pressure upstream of the nozzle is not reduced to nothing; instead, a residual pressure remains, which prevents the development of vapor bubbles.

In FIG. 3, a modified embodiment of the control part 7 described in conjunction with FIG. 2 is shown. Identical components are identified by the same reference numerals. The structure of the embodiment of FIG. 3 is essentially equivalent to that described in conjunction with FIG. 2. The distinction is first that the valve body 23 is embodied in one piece, and on the side toward the actuator, the pressure piston 23.1 is solidly connected to the valve body 23. The pressure piston 23.1 has a smaller diameter than the piston parts 23.2 and 23.3.

In the embodiment of FIG. 3, a hydraulic seat valve is provided as the relief valve 27; its piston part 27.1 presses a valve needle 27.2 against its sealing seat, so that the connecting line 6 is blocked off from the low-pressure channel 17. Upon actuation of the valve, via the pressure buildup in the hydraulic chamber 20.4, the closing force of the relief valve 27 is increased in proportion to pressure, and the relief valve 27 is thus reliably kept in the closing direction in the presence of the injection pressure in the connecting channel 6. If the actuator is deprived of voltage and shortens its length, then the pressure reduction in the hydraulic chamber 20.4 as well as the fuel still at injection pressure in the connecting channel 6 suffice to open the relief valve 27 briefly, counter to the force of a closing spring 27.3 embodied as a cup spring, so as to assure the pressure reduction in the connecting channel 6 via the low-pressure channel 17 as well.

In FIG. 4, a further embodiment of the control part 7 is shown. The structure is essentially equivalent to the structure of the embodiment described in conjunction with FIG. 3, which can therefore be referred to in this respect. The difference here is solely that a separate relief valve is not provided; instead, the valve body 23 is designed, in the region of its end acting as a pressure piston 23.1, as a relief valve 27 and to that end is embodied as a slide valve. As can be seen from the enlarged view in FIG. 5, the end of the valve body 23 acting as a pressure piston 23.1 is shaped so as to taper conically on its end toward the valve chamber 21, or is provided with an oblique flat face or a groove, specifically in such a way that in the closing direction of the valve body 23, the end toward the actuator of the conical part 27.4 protrudes into an annular chamber 27.5 communicating with the low-pressure channel 17 and thus leaves a flow cross section open.

As soon as the valve body 23 is displaced via the actuator 20 in the opening direction (arrow 28), the annular chamber 27.5 is closed off from the valve chamber 21, so that in accordance with the opening of the flow cross section at the valve seat 22, fuel can flow from the high-pressure channel 8 into the connecting channel 6 and build up the injection pressure.

If the actuator 20 is deprived of voltage, then the valve body 23, under the influence of the force of the closing spring 24 and the pressure imposition via the compensation piston 25, moves in the direction of the valve seat 22. The flow cross section at the annular chamber 27.5 is uncovered in the process, so that the pressure in the connecting channel 6 can be reduced. The arrangement here is dimensioned such that the opening of the flow cross section to the annular chamber 27.5 is enabled practically simultaneously with the seating of the blocking part 23.2 on the valve seat 22.

In the embodiment of the relief valve 27 described in conjunction with FIG. 3 as well, by suitable dimensioning, the pressure reduction at the injection valve can be conducted such that vapor bubble formation is avoided. In the embodiment described in conjunction with FIG. 4, this can be achieved by means of an additional pressure limiting valve, connected to the line 17.

The embodiments of the control part 7 described in conjunction with FIGS. 3 and 4 can be employed in the same way as described in conjunction with FIG. 2, namely as a structural unit combined with a nozzle part 5. However, as can be seen from the basic illustration in FIG. 1, it is also possible for all forms of the control part 7 to provide an arrangement in which the control part 7 is disposed separately from the nozzle part 5. Accordingly, in the schematic illustration in FIG. 1, the branch line 26 leading to the control part 7 is indicated by dot-dashed lines.

In the ensuing FIGS. 6–9, a modified embodiment of the injection nozzle of FIG. 2 is shown in the form of a flow chart, in which only the parts essential to the function are shown in detail. Identical components are again provided with the same reference numerals, so that the above description of the other exemplary embodiments can be referred to for both the structure and the function.

In the embodiment of FIG. 6, the valve assembly 21.0 is preceded by a so-called pressure divider 30. In FIG. 7, one embodiment of the pressure divider 30 is shown on a larger scale. The pressure divider essentially comprises a piston body 31, which is operatively connected (arrow 20 in FIG. 7) by its upper end to the actuator 20 and on its lower end is braced on a restoring spring 33 via a spring plate 32. The piston body 31 is provided with a valve body 34, which cooperates with a first valve seat 35.1. In the pressure relieved state, the valve body 34 is pressed onto the first valve seat 35.1 by the restoring spring 33.

Associated with the valve body 34, on its side toward the restoring spring, is a second valve seat 35.2, which connects the annular chamber 37 with the outflow chamber 39, and which the valve body 34 closes to a greater extent, the farther it moves in the direction of the arrow 20. The valve body 34 together with the valve seats 35.1 and 35.2 thus forms a 3/2-way proportional valve with 100% negative overlap. As a result of this arrangement, the pressure in the annular chamber 37 rises approximately linearly with the adjustment travel of the valve body 34, from 0 bar when the valve body is in contact with the valve seat 35.1 up to the pressure prevailing in the line 8, when the valve body is in contact with the valve seat 35.2. Depending on the diameter of the valve seat 35.2, a feedback of the pressure in the annular chamber 37 to the actuator 20 takes place, so that even an electromagnetic actuator can be used. The valve seat 35.2 can be embodied as a flat seat, in order to minimize the demands made in terms of production precision.

Also associated with the valve body 34 is a first annular chamber 36, into which a branch line 8.1 of the high-pressure line discharges, and which is closed off by the closing direction defined by the valve seat 35.1. The valve body 35 is disposed in a second annular chamber 37, which communicates via an overflow line 8.2 with a pressure chamber 38, which is defined by the valve body 23 on its side remote from the restoring spring 24. The valve body 34 is also associated, in the region of the restoring spring 33, with an outflow chamber 39, which communicates with the low-pressure channel 17 via an outflow line 40.

Via a line, the pressure chamber 38 communicates with a pressure chamber 41, the latter being associated with the piston part 27.1 of the relief valve 27.

If the valve body 34 is lifted from its valve seat 35.1 by the amount predetermined by the energy imposed via a piezoelectric actuator, then fuel at a correspondingly high pressure flows out of the high-pressure channel 8 via the connecting line 8.1 into the annular chamber 36 and on into the pressure chamber 38 via the connecting line 8.2. As a result, the valve body 23 is displaced in proportion to pressure counter to the force of the restoring spring 24, and the flow to the connecting channel 6 to the injection valve 5 is opened accordingly. The injection pressure prevailing in the connecting channel 6 also acts on the side of the valve body 23 toward the spring 24, the pressure-loaded surface of which valve body is precisely the same size as the pressure-loaded surface of the side of the valve body oriented toward the chamber 38. Since the force of the spring 24 is slight in comparison with the pressure forces applied, the valve body 23 always opens widely enough that the pressures in the chamber 38 and the connecting channel 6 are equal.

On the basis of the above-described function of the pressure divider 30, the injection pressure can be modulated during the injection, by triggering the actuator 20 precisely far enough that it moves the valve body 34 into a position between the two valve seats 35.1 and 35.2, which position adjusts the pressure that is desired as the injection pressure in the annular chamber 37 and thus also in the chamber 38. The pressure in the annular chamber 3 also prevails in the pressure chamber 41 at the piston body 27.1 of the relief valve 27, so that this pressure acts, reinforcing the closing spring 27.3, in the closing direction against the valve body 27.2.

If the actuator 20 is deactivated, then the valve body 34 of the pressure divider 30 takes it seat on its valve seat 35.1, so that the pressure chambers 41 and 38 are pressure-relieved, and the valve assembly 21.0 thus closes. The pressure still prevailing in the connecting channel 6 can be reduced quite rapidly via the line 17.1 and the relief valve 27, so that the valve spring 16 very quickly puts the nozzle needle 9 in the closing direction; the valve spring 27.3 is designed such that on the one hand the fastest possible pressure reduction takes place, but on the other, a residual pressure remains, so that vapor bubble formation is avoided.

The embodiment of FIG. 8 is identical in function, with regard to the control part 7, to the embodiment described above for FIGS. 6 and 7. The difference is only that the piston body 31 of the pressure divider 30 is provided, on its end toward the restoring spring 33, with a compensation piston 42, which can be subjected to the partial pressure via a branch line branching off from the overflow line 8.2, and a pressure feedback can thus be effected. This makes it possible to actuate the pressure divider 30 in the direction of the arrow via an electromagnetic actuator.

The modification shown in FIG. 9 is essentially equivalent to the above-described structure of FIGS. 6 and 7. The control part 7 is merely modified here in such a way that the pressure chamber 41 of the relief valve communicates directly, via a throttle 43, with the low-pressure channel 17, and the pressure divider 30 here can be embodied as a 2/2-way valve.

In the embodiment of FIG. 9, the pressure divider 30 is not acted upon directly via the actuator 20, but instead via a hydraulic travel booster 43, of the kind already described in conjunction with the embodiment of FIGS. 2 and 3. Via a feed line 44, the unavoidable leakage losses in the hydraulic chamber of the hydraulic travel booster are compensated for. The travel booster described can be combined with all the variants described for the injection system.

In FIG. 10, an embodiment of the injection valve with a nozzle needle 9 that can be opened in two stages is shown. The nozzle needle 9 is braced here on the housing, via a first, soft closing spring 16.1. A slide body 16.3 is also provided, which is braced with its side remote from the nozzle needle 9 against a second, harder closing spring 16.2. The slide body 16.3 has a support extension 16.4, which ends a slight distance a upstream, in terms of the closing direction of the nozzle needle 9, of the end of the piston body 15 of the nozzle needle 9.

If via the connecting channel 6 the pressure chamber 10 is subjected to a pressure that is less than the restoring force of the restoring spring 16.2, then the injection valve opens only by a stroke corresponding to the amount a. If the pressure chamber 10 is acted upon by a pressure that is greater than the restoring force of the closing spring 16.2, then the nozzle needle 9 is displaced backward correspondingly far, and the injection valve opens completely.

In FIG. 11, a modification of the embodiment of FIG. 10 is shown. In this embodiment, the closing spring 16 is braced on an escape piston 16.5, which on its side remote from the closing spring has a pressure chamber 16.6, which is connected to the connecting channel 6 via a throttle 16.7. A pressure-dependent, dynamic guidance of the opening motion of the nozzle needle 9 is possible via this arrangement.

With a fuel injection device of the type according to the invention, it is possible, even in high-speed Diesel engines, in particular Diesel engines for passenger cars, which under full load can have rotary speeds of 4000 to 4500 rpm and in which high injection pressures of approximately 1500 to 2000 bar exist, to achieve short injection times, for instance of 1.5 milliseconds, specifically by means of direct triggering of the control part.

What is claimed is:

1. A fuel injection device for a reciprocating internal combustion engine, having a nozzle part (5) with an injection nozzle (13), which part has a pressure chamber (10) in which the nozzle needle (9) that closes the injection nozzle (13) is guided, which needle is movable in the opening position upon imposition of pressure by the fuel to be injected, wherein the pressure chamber (10) communicates via a connecting channel (6) with a control part (7) which has a valve chamber (21), into which the connection to channel (6) on the one hand and a high-pressure channel (8), communicating with a fuel supply (4), on the other hand for discharging, and in which a valve body (23) acting as a piston system is guided, which body is kept in the closing position on a valve seat (22) by a valve spring (24), and having an actuator (20), which is operatively connected to the valve body (23) and which moves the valve body in the opening direction upon activation and enables the flow from the high-pressure channel (8) into the connecting channel (6), and having a compensation piston (25; 42) which is acted upon counter to the force action of the actuator via the pressure in the connecting channel (6).

2. The fuel injection device of claim 1, characterized in that the compensation piston (26), which can be acted upon via the pressure in the connecting channel (6), is disposed on the valve body, on its end (25) remote from the actuator (20).

3. The fuel injection device of claim 1, characterized in that the connecting channel (6) is provided with a relief valve (27), which opens toward the low-pressure side (17) of the fuel supply (14), and which is closed upon activation of the actuator (20).

4. The fuel injection device of claim 1, characterized in that a tension spring (20.5) is disposed between the actuator (20) and the valve body (23).

5. The fuel injection device of claim 1, characterized in that the actuator (20) has a transmission piston (20.3), and the end of the valve body (23) oriented toward the actuator (20) has a pressure piston (23.1), and that between the two pistons, a hydraulic chamber (20.4) is disposed, and the diameter of the pressure piston (23.1) is less than the diameter of the transmission piston (20.3).

6. The fuel injection device of claim 1, characterized in that the diameter of the compensation piston (25), depending on the desired force feedback is less than, equal to, or greater than the diameter of the part of the piston system of the valve body (23) that acts in the opening direction upon imposition of pressure.

7. The fuel injection device of claim 1, characterized in that the actuator (20), with respect to its adjustment travel, is embodied adjustingly in proportion to the adjustment energy applied.

8. The fuel injection device of claim 1, characterized in that an electrical actuator (20) is provided, which is embodied adjustingly in proportion to voltage with respect to its adjustment travel.

9. The fuel injection device of claim 1, characterized in that an electrical actuator (20) is provided, which is embodied adjustingly in proportion to current with respect to its adjustment travel.

10. The fuel injection device of claim 1, characterized in that the control part (7) has a pressure divider (30), which communicates on the one hand with the high-pressure channel (6) and on the other with the valve body (23) forming a piston system, the valve body having a pressure compensation piston (23.1; 42) acting as a compensation piston, which can be acted upon by the pressure acting in the connecting channel (6), counter to the actuator force, and which is adjustable via the actuator.

11. The fuel injection device of claim 1, characterized in that a pressure divider (30) is operatively connected to a relief valve (27).

12. The fuel injection device of claim 11, characterized in that the relief valve (27) has a valve spring (27.3), acting on a valve body (27.2) in the closing direction, and a piston (27.1) which can additionally be acted upon in the closing direction via the pressure divider (30).

13. The fuel injection device of claim 1, characterized in that a pressure divider (30) is embodied as a 3/2-way valve, and the two valve seats of the 3/2-way valve represent two throttle restrictions of the pressure divider (30).

14. The fuel injection device of claim 1, characterized in that a valve seat (35.2) of a pressure divider (30) is embodied as a flat seat.

* * * * *